United States Patent [19]

Musielak

[11] Patent Number: 5,007,250

[45] Date of Patent: Apr. 16, 1991

[54] INSULATED COOLING CONTAINER FOR CANNED LIQUIDS

[75] Inventor: Ronald L. Musielak, Downers Grove, Ill.

[73] Assignee: R.V.R. Enterprises, Ltd., Lombard, Ill.

[21] Appl. No.: 429,988

[22] Filed: Nov. 1, 1989

[51] Int. Cl.[5] ..... F25D 3/08

[52] U.S. Cl. ..... 62/372; 62/457.1; 62/457.5; 62/458

[58] Field of Search ..... 62/372, 457.1, 457.5, 62/458

[56] References Cited

U.S. PATENT DOCUMENTS

| | | | |
|---|---|---|---|
| 2,730,151 | 1/1956 | Smith | 62/457.1 X |
| 4,266,407 | 5/1981 | Gibson | 62/457.5 X |
| 4,343,158 | 8/1982 | Campbell | 62/457.1 X |
| 4,655,052 | 4/1987 | Garcia | 62/458 |
| 4,858,444 | 8/1989 | Scott | 60/372 |

*Primary Examiner*—Lloyd L. King

*Attorney, Agent, or Firm*—Howard B. Rockman

[57] ABSTRACT

A portable insulated cooling container comprising a first compartment, a second compartment, and a handle, the first compartment being separate from the second compartment, the first compartment adapted to receive a plurality of beverage containers and the second compartment adapted to receive a coolant, with the beverage containers being directly accessible from the first compartment.

10 Claims, 3 Drawing Sheets

INSULATED COOLING CONTAINER FOR CANNED LIQUIDS

FIELD OF THE INVENTION

This invention relates to an insulated cooling container for canned liquids. More particularly, this invention relates to a portable insulating container having two separate compartments, with beverage cans stored in one of the two compartments separate from a coolant in the other compartment, whereby the cans and coolant can be independently inserted in or removed from the container.

BACKGROUND OF THE INVENTION

A variety of portable containers which keep beverages cool are known. These portable containers include a device for maintaining a desired low temperature for the beverages. However, it has been discovered that while such portable containers are popular, there are problems associated with their use, including inadequate cooling mechanisms, inaccessibility of the contained beverages, and awkward, bulky designs of the containers.

One such presently available portable container for keeping beverages cool is shown in Gibson patent No. 4,266,407, which illustrates a portable cooler having a coolant and a container with indentations for holding cans. However, this cooler does not include a structure having two separate compartments, one in which the cans are readily accessible and may be removed directly from the one compartment of the bag without opening the entire container, or the other compartment of the container holding the coolant device. Moreover, the Gibson cooler does not show cans which are cooled along their entire length by a coolant device.

Other portable containers include lids that insulate beverages in containers, such as the portable containers disclosed in Atkinson patent No. 4,295,345, Rhodes patent No. 4,459,827 and Pitchford patent No. 4,620,426. However, these containers do not teach the use of two separate compartments, one from which the cans are readily accessible without opening the entire container, and the other which holds a coolant.

Accordingly, an object of the present invention is to provide an insulated cooling container for canned liquids having two separate compartments, with cans stored in one of the two compartments, separate from the coolant which is stored in the other compartment.

Another object of the present invention is to provide an insulated cooling container for canned liquids having a coolant with individual recesses that individually nest and cool each can over a relatively large surface area.

Another object of the present invention is to provide an insulated cooling container for canned liquids where the cans are directly accessible for removal without disturbing the coolant in a separate, adjacent compartment.

A further object of the present invention is to provide an insulated cooling container for canned liquids which is adapted to fit into the shoe compartment of a golf bag.

SUMMARY OF THE INVENTION

The present invention, in the preferred embodiment, comprises a structure that accomplishes the foregoing objects by providing an insulated cooling container for canned liquids having two separate compartments, with beverage containers stored in one of the two compartments, separate from the coolant, and the containers being directly accessible for removal. The container comprises, in part, a body, a handle, a first zipper defining an opening providing access to a first compartment and a second zipper defining an opening providing access to a second compartment. The first zipper extends lengthwise down the frontside of the container, and opens and closes a single first compartment inside the bag which houses the beverage cans. The cans are placed in and removed from the first compartment through the opening defined by the first zipper. The second zipper is located on top of the container and allows placement of a coolant material into a separate second compartment in the bag. The coolant is formed by a hollow sealed case that encloses a refrigerant, such as "Blue Ice", and is preferably shaped with scallop-type recesses that individually nest and cool each can over a larger surface area. The compartments are separated by a thin, pliable material that allows the cans in one compartment to nest on the scalloped recesses of the coolant, with only the thin separating material between the cans and the coolant. The separating material has no insulating value, and the coolness of the coolant is transferred to the beverages in the cans.

It is precisely this structure of the container that enables the cans to be directly accessible for removal from and insertion into a compartment separate from the coolant compartment, and which provides for cooling of the cans over a greater surface area. The above-described structure of the container also is adapted to fit into the shoe compartment of a golf bag.

The above, as well as other objects and advantages of the invention, will become apparent from the following detailed description of the preferred embodiments, reference being made to the accompanying drawings.

DETAILED DESCRIPTION OF THE INVENTION

Figure 1:
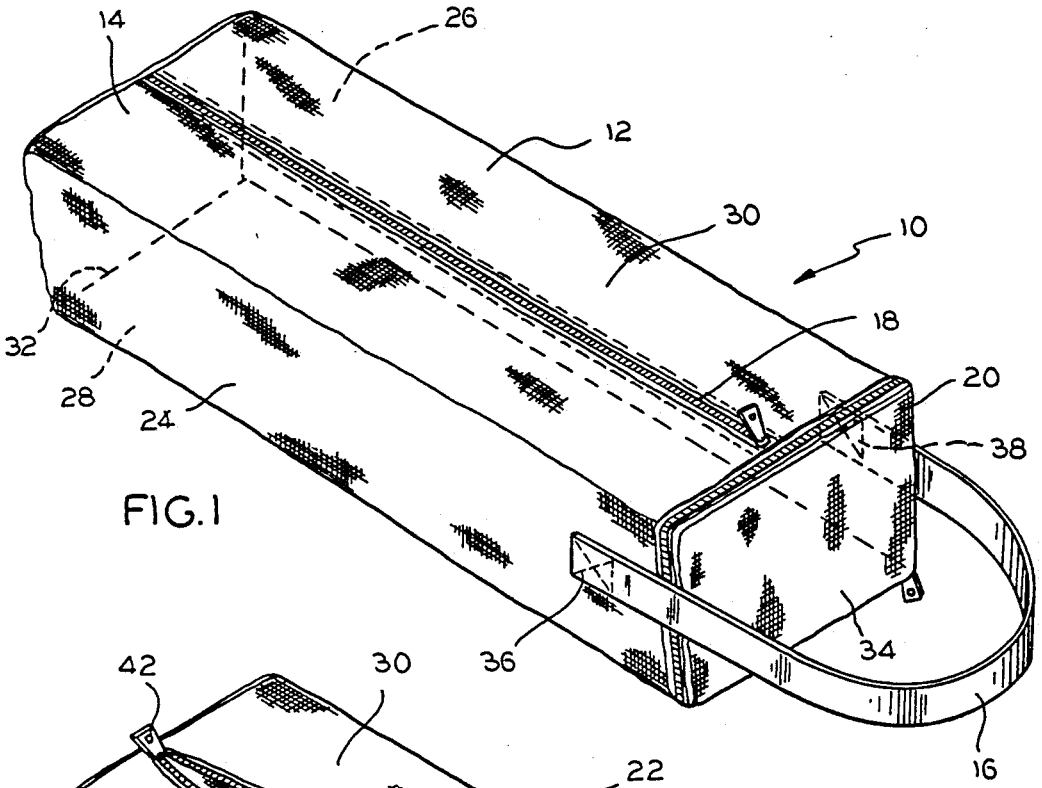
FIG. 1 is a perspective view of the inventive container.

FIGS. 1–8 illustrate the inventive coolant device 10 which consists of a container 12 having, in part, a body 14, a handle 16, a first closure device comprising a zipper 18 and a second closure device comprising a zipper 20. First zipper 18 extends lengthwise down the frontside of container 12 and opens and closes a single first compartment 22 inside container 12 which house a plurality of beverage cans. Second zipper 20 is located on one end of the container 12 and allows placement and removal of a coolant 50 into a second compartment 40.

Referring first to FIG. 1, coolant device 10 consists of container 12, which is generally rectangular in shape and includes a body 14 having a first and second side 24,26, a backside 28, a frontside 30, a bottom 32 and a top 34. The sides opposite each other, for example, backside 28 and frontside 30, are the same size and have equal dimensions. Container 12 is preferably made of canvas on the exterior and has an insulating mat of foam or another comparable insulating material in the interior, lining the insides of each of the outer sides. Handle 16 is securely attached to first and second side 24,26 at 36,38, respectively.

Figure 2:
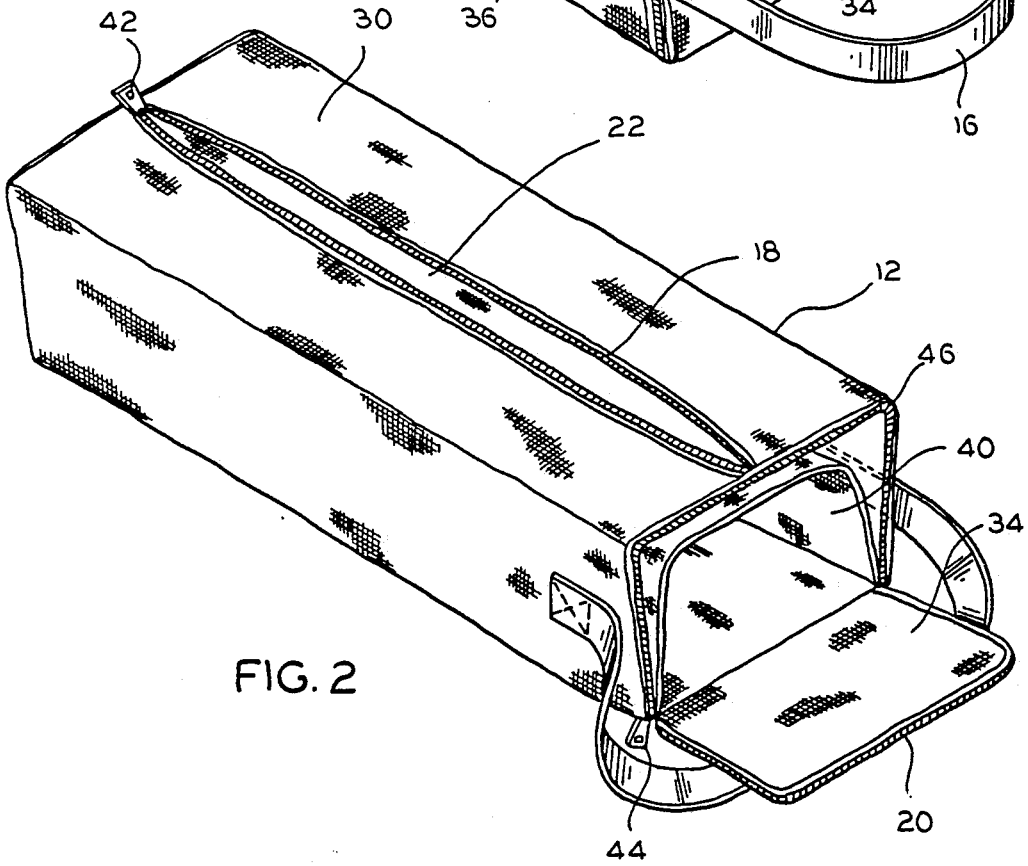
FIG. 2 is a perspective view of the container of FIG. 1, illustrating the two compartments in an open position.
Figure 3:
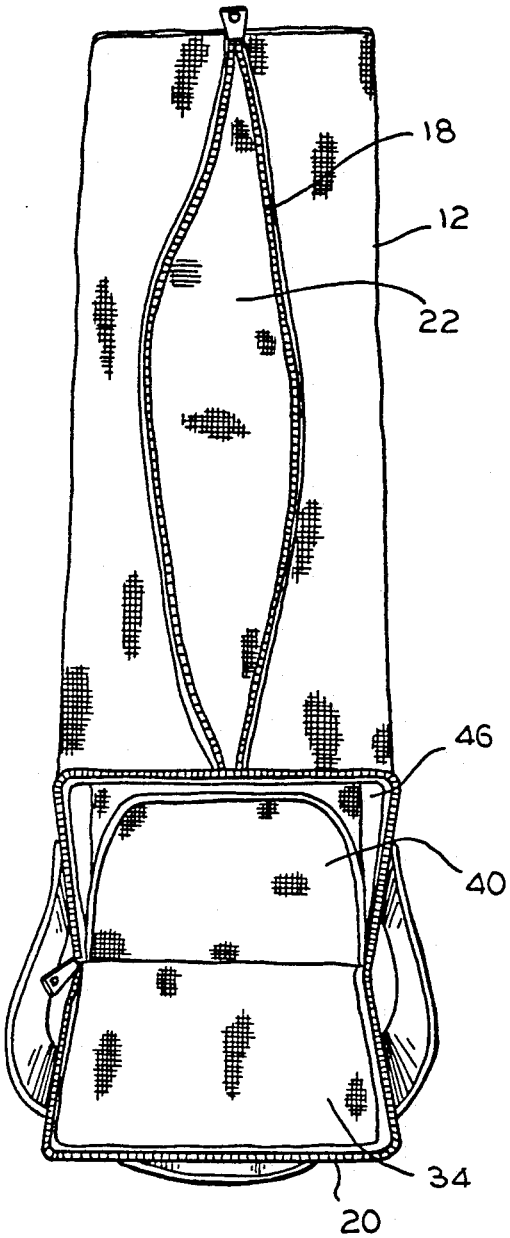
FIG. 3 is a frontal perspective view of the container of FIG. 1, showing the compartments in their open position.

Referring to FIGS. 2 and 3, frontside 30 includes a first zipper 18 which extends lengthwise down the frontside of container 12 and opens and closes a first compartment 22 therein. Top 34 includes a second zipper 20 which extends around three sides of the perimeter of top 34 and opens and closes second compartment 40. Tabs 42 and 44 are provided to open first and second zippers 18 and 20, respectively.

First compartment 22 and second compartment 40 are separated from one another within container 12 by a pliable layer 46, (FIG. 2), preferably made of nylon or other suitable material, that is permanently attached within container 12. Layer 46 has a large surface area to provide first compartment 22 with a large storage capacity, as will be explained, and has substantially no insulating value.

First compartment 22 is adapted to house cans 48 which contain beverages (FIG. 5), whereas second compartment 40 is adapted to house a coolant material 50. Nylon layer 46 separates the cans 48 in first compartment 22 from the coolant 50 in second compartment 40.

Figure 4:
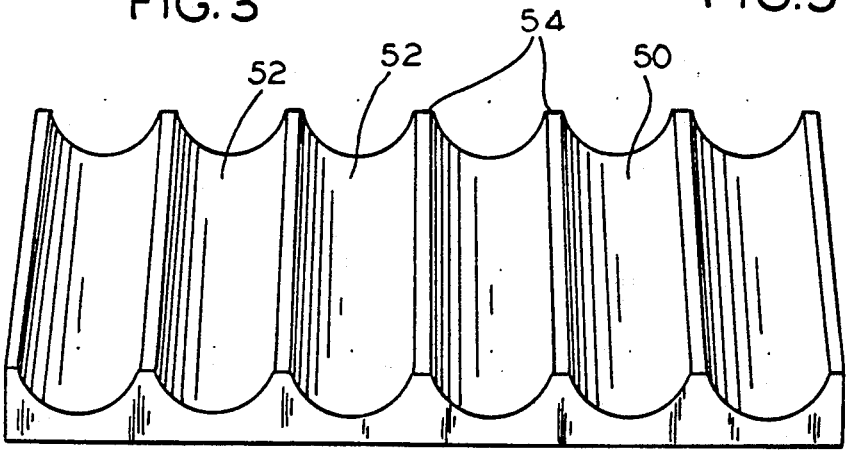
FIG. 4 is a perspective view of the coolant material that is placed inside a compartment of the container of FIG. 1.

FIG. 4 illustrates one preferred shape of coolant material 50. Coolant material 50 is generally the same length and width as second compartment 40 of container 12, and is formed by a hollow sealed case that encloses a refrigerant, such as "Blue Ice", and is scalloped on one side, providing recesses 52 that are adapted to individually lodge each of cans 48. In the illustrated embodiment, coolant material 50 generally includes six recesses, which are separated by ridges 54. Coolant material 50 is refrigerated prior to being placed into second compartment 40 of container 12.

Figure 5:
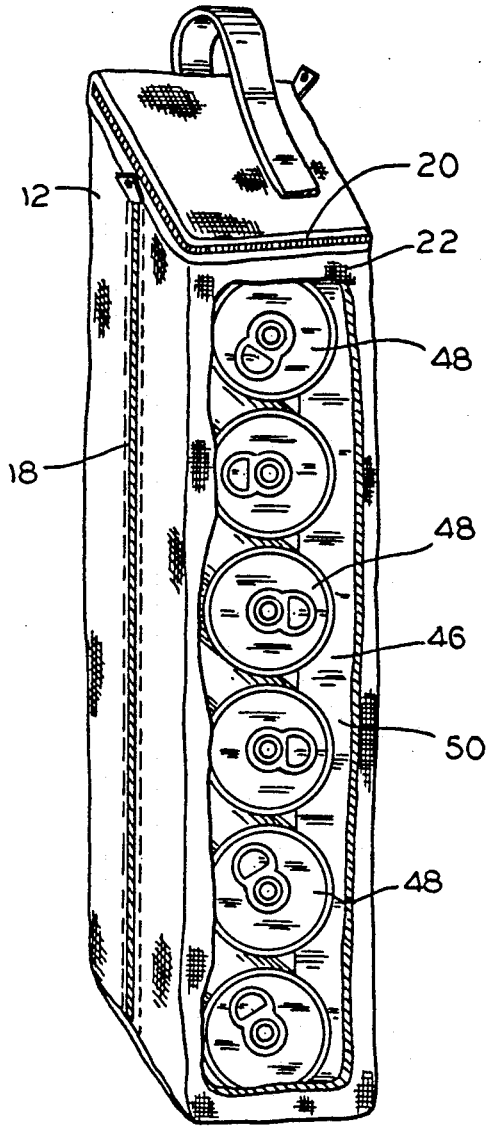
FIG. 5 is a cut-away longitudinal perspective view of the container of FIG. 1.

FIG. 5 illustrates the manner in which cans 48 rest within recesses 52 of coolant material 50. Cans 48 lie flat within recesses 52 and are perpendicular to the lengthwise extent of first zipper 18. The dimensions of container 12 are such that cans 48 abut the interior sidewalls 24,26, and the interior of frontside 30 when they are inserted in the container, and zipper 18 is closed. This configuration secures cans 48 in recesses 52. As FIG. 5 discloses, cans 48 never rest directly on coolant material 50, but instead on nylon layer 46, which is oversized and loose enough to conform to the shape of recesses 52 of coolant material 50 when cans 48 are placed inside of first compartment 22. The width of coolant material 50, and therefore the axial length of recesses 52, is substantially the same as the width of the container 12, and substantially the same as the axial length of each of the cans 48. When cans 48 are secured in recesses 52 over pliable layer 46, the coolant material 50 comes into contact with the entire length of each can 48, and over a substantially large portion of the circumferential extent of each can 48 due to the arced configuration of recesses 52, which arc is substantially the same as the circular dimension of each can.

To use container 12, a refrigerated coolant material 50 of the type above described is placed into second compartment 40 by opening second zipper 20 and inserting the coolant material through the aperture created by flipping over top 34. Second zipper 20 is preferably kept closed subsequent to insertion of coolant material 50 into second compartment 40 to maintain the desired low temperature in the interior of container 12. Cans 48 are then placed into first compartment 22 by opening first zipper 18. As FIG. 5 illustrates, cans 48 are lodged in first compartment 22 with the length of cans 48 being parallel to the recesses 52 of coolant material 50, and on top of nylon layer 46. The cans 48 are cooled by coolant material 50, since nylon layer 46 has no significant insulating value. First zipper 18 is closed after the insertion or removal of each can 48 from first compartment 22.

Figure 6:
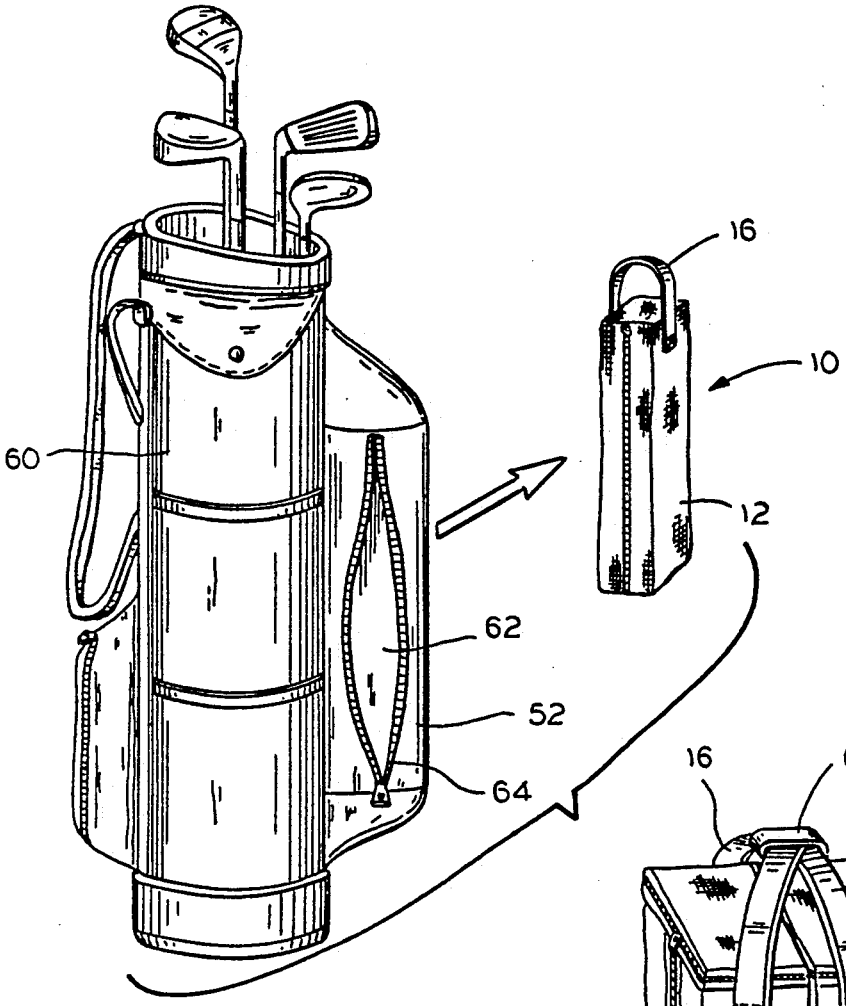
FIG. 6 is a perspective view of a golf bag and the inventive container of FIG. 1, illustrating the manner in which the container is positioned into the shoe compartment of the golf bag.

After cans 48 and coolant material 50 have been inserted into first compartment 22 and second compartment 40, respectively, container 12 may be transported in an upright position by handle 16, as illustrated in FIG. 6, with the coolant material 50 keeping the beverage in cans 48 cool. The insulating material on the interior walls of the container 12 maintains a cool environment inside the container. FIG. 6 also shows that container 12 is configured to be inserted into a shoe compartment 59 of a golf bag 60. Generally, shoe compartment 59 of golf bag 60 includes an opening 62 into which container 12 may be inserted. Shoe compartment 59 is opened and closed by a zipper 64, or other suitable closure device. Cans 48 may be removed by initially opening zipper 64 of shoe compartment 59, and then opening first zipper 18 of container 12.

Figure 7:
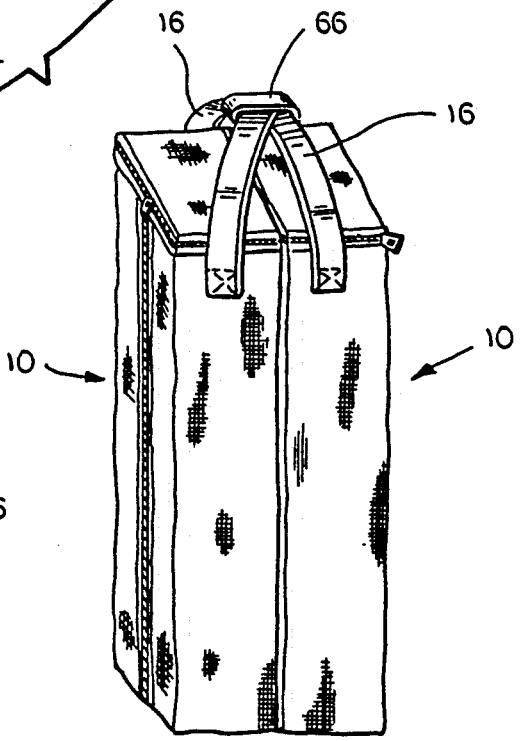
FIG. 7 is a perspective view of another embodiment of the invention, illustrating two of the containers of FIG. 1 secured to each other at their handles.
Figure 8:
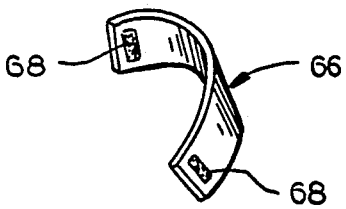
FIG. 8 is a perspective view of a fastener that is used with the embodiment of FIG. 7.

FIG. 7 discloses another embodiment of the inventive device 10. This embodiment is exactly the same as the embodiment of FIG. 1, except that the apparatus of FIG. 7 includes a second container 12' which is secured to a first container 12, of the type disclosed in FIG. 1 by handles 16 and 16' with a separate grip piece 66. Grip piece 66 (FIG. 8) is generally rectangular in shape and includes a Velcro® type fastener at each end on opposite sides of grip piece 66.

Grip piece 66 is used to secure handles 16 and 16' of containers 12 and 12' by inserting piece 66 through handles 16 and 16' of each container 12, 12' and fastening piece 66 together with the Velcro® type fastener 68. If desired, additional fastening elements, such as snaps by way of example, along the lengths of abutting sides of containers 12, 12' may be used to secure the two containers together along their lengthwise dimensions. Thus, the embodiment of FIG. 7 provides a single means to attach and transport two containers 12, 12' together. This embodiment also provides a means to transport twelve cans as opposed to only six cans in the exemplar embodiment of FIG. 1.

The materials from which containers 12 and 12' of the different embodiments is constructed includes canvas or nylon material for the exterior of container 12 and pliable layer 46, with the interior of container 12 incorporating any suitable type of insulating material. The structure that contains coolant material 50 is preferably constructed from a rigid plastic material.

Container 12 has not been described in terms of approximate measurements, as it should be understood that the size of the container may vary according to need. The sizes can vary, but are limited to the manufacturing equipment's capabilities, and the size of the beverage containers to be held in the container 12.

Therefore, it should be recognized that, while the invention has been described in relation to preferred embodiments thereof, those skilled in the art may develop a wide variation of structural details without departing from the principles of the invention. Therefore, the appended claims are to be construed to cover all equivalents falling within the true scope and spirit of the invention.

I claim:

1. A portable insulated cooling container comprising a first compartment adapted to receive beverage containers to be maintained in a cool state; a second compartment adapted to receive a coolant material, a pliant substantially non-insulating material in said cooling container separating said first compartment and said second compartment; a first opening in said first compartment, and first closure means to selectively open and close said first compartment; a second opening in said second compartment, and second closure means to selectively open and close said second compartment; said first and second compartment being independently accessible through said first and second openings, respectively.

2. The cooling container of claim 1 wherein said pliant material contacts and conforms to one surface of said coolant material when said beverage containers are placed in said first compartment, whereby said beverage containers are lodged in said cooling container against said coolant material, separated by said pliant material.

3. The cooling container of claim 2 wherein said pliant material is attached to the interior of said cooling container.

4. A portable insulated cooling container comprising a first compartment and a second compartment, said first compartment having a first opening which selectively opens and closes said first compartment, said second compartment having a second opening which selectively opens and closes said second compartment, said first and second compartments being independently accessible through said first and second openings respectively, said first compartment being separated from said second compartment by a substantially non-insulating pliable material, said first compartment adapted to receive a plurality of beverage containers and said second compartment adapted to receive a coolant material, said beverage container being directly accessible from said first compartment and lodged in said first compartment in contact with said pliable material, said pliable material conforming to the shape of and in contact with said coolant material.

5. The portable insulated cooling container of claim 4 wherein said pliable material is attached to the interior of said container.

6. The portable insulated cooling container of claim 4 wherein said plurality of beverage containers inside of said first compartment are cooled by said coolant inside of said second compartment.

7. The portable insulated cooling container of claim 4 wherein said coolant includes a plurality of recesses that individually nest said cans over a relatively large surface area.

8. The portable insulated cooling container of claim 4 wherein an additional cooling container is releasably attached side by side and lengthwise to said cooling container by a grip piece.

9. A portable insulated cooling container comprising a first compartment and a second compartment, said first compartment having a first opening which selectively opens and closes said first compartment, said second compartment having a second opening which selectively opens and closes said second compartment, said first and second compartments being independently accessible through said first and second openings respectively, said first compartment being separated from said second compartment by a pliable layer, said pliable layer being attached to the interior of said cooling container, said first compartment adapted to receive a plurality of beverage containers and said second compartment adapted to receive a coolant material, said beverage containers being directly accessible from said first compartment and lodged in said first compartment in contact with said pliable material, said pliable material conforming to the shape of and in contact with said coolant material.

10. The portable insulated cooling container of claim 9 wherein an additional cooling container is attached side by side and lengthwise to said cooling container.

* * * * *